US006532996B2

(12) United States Patent
Tamura

(10) Patent No.: US 6,532,996 B2
(45) Date of Patent: Mar. 18, 2003

(54) METHOD AND APPARATUS FOR DRIVING A LOOM

(75) Inventor: Zenji Tamura, Ishikawa-ken (JP)

(73) Assignee: Tsudakoma Kogyo Kabushiki Kaisha (JP)

( * ) Notice: Subject to any disclaimer, the term of this patent is extended or adjusted under 35 U.S.C. 154(b) by 0 days.

(21) Appl. No.: 10/076,153

(22) Filed: Feb. 14, 2002

(65) Prior Publication Data

US 2002/0153051 A1 Oct. 24, 2002

(30) Foreign Application Priority Data

Apr. 5, 2001 (JP) ..... 2001-107176

(51) Int. Cl.[7] ..... D03D 51/00
(52) U.S. Cl. ..... 139/1 E; 139/370.2
(58) Field of Search ..... 139/370.2, 1 E, 139/55.1, 1 R, 116.2, 79

(56) References Cited

U.S. PATENT DOCUMENTS 4,570,681 A 2/1986 Wada Yoshimi
5,228,480 A * 7/1993 Tamura ..... 139/1 E
5,467,801 A * 11/1995 Kaneda et al. ..... 139/1 E

FOREIGN PATENT DOCUMENTS

| | | |
|---|---|---|
| EP | 0950741 A | 10/1999 |
| JP | 50-20126 | 6/1975 |
| JP | 6-99860 | 12/1994 |

* cited by examiner

*Primary Examiner*—John J. Calvert
*Assistant Examiner*—Robert H. Muromoto, Jr.
(74) *Attorney, Agent, or Firm*—Webb Ziesenheim & Logsdon Orkin & Hanson, P.C.

(57) ABSTRACT

A method of driving a loom is characterized by driving devices of a loom according to instructions for works and stopping a drive actuator on the basis of stop position information. The stop information used to stop the drive actuator is set relative to the devices of the loom, and is set prior to adjusting, maintaining, or initializing the devices of the loom.

8 Claims, 5 Drawing Sheets

FIG.3

WORKS SELECTION [1] ↵

1.SETTING
2.LOOMING
3.MAINTENANCE
4.YARN BREAKAGE

FIG.4

SELECT OBJECT DEVICE (1) [4] ↵

1.BEATING UP DEVICE
2.SHEDDING DEVICE
3.WEFT INSERT DEVICE
4.SELVAGE DEVICE
5.WARP LET-OFF DEVICE
6.WEFT CUTTER
⋮

FIG.5

SELECT OBJECT WORKS (2) [2] ↵
4.SELVEGE DEVICE (PLANETARY GEAR SYSTEM)

1.CLOTH WIDTH ADJUSTMENT
2.WEFT YARN SUPPLY-SIDE PHASING
3.NON-SUPPLY SIDE PHASING
4.OILING
5.ATTACHING BOBBIN
⋮

FIG.6

CONFIRM WORK CONTENTS [1] ↵
4.SELVAGE DEVICE
2.WEFT YARN SUPPLY-SIDE PHASING
CONTENTS: (1) MAIN SHAFT ROTATES UP TO 290°
(2) LOOSEN TRANSMISSION GEAR AND FIX IT AT POSITION WHERE SHEDDING IS ALMOST CLOSED.

FIG.7

4-2. (1) MAIN SHAFT IS ROTATABLE UP TO 290°

TO BE EXECUTED ? Y/N

[Y] ↵

FIG.8

WARNING

ROTATION OF MAIN SHAFT IS
TO BE STOPPED ? Y/N

N ↵

FIG.9

4.2 (1) MAIN SHAFT FINISHED DRIVING (STOPPED AT 290°)
(2) INSTRUCTIONS
LOOSEN BOLT OF TRANSMISSION GEAR AND FIX IT AT POSITION WHERE SELVAGE YARN SHEDDING IS NEARLY CLOSED.
COMPLETED ? Y/N

Y ↵

FIG.10

STOPPAGE DRIVING OF MAIN SHAFT
BY PRESSING STOP BUTTON

CONFIRMED ? Y/N

Y ↵

METHOD AND APPARATUS FOR DRIVING A LOOM

BACKGROUND OF THE INVENTION

1. Field of the Invention

The present invention relates to a method and an apparatus for driving a loom comprising a weft insert device, a shedding device, a beating-up device, a cloth take-up device, warp let-off device, etc., and more particularly, to a method and an apparatus suitable for driving a drive actuator of such a device during stoppage of the loom.

2. Description of Prior Art

A loom is provided with various machines and devices such as a weft insert device, a shedding device, a beating-up device, a cloth take-up device, a warp let-off device and the like, and make them perform various motion such as inserting, shedding, beating up, taking up cloth, letting off warps and the like by driving such devices.

Since the devices are driven in correspondence to, for example, rotation of the main shaft of a loom, they should undergo such operations as phasing (timing adjustment) relative to the main shaft, and further, mechanical adjustment and setting of an amount of driving, driving position, etc., according to the specification of a cloth. Such operations should be performed, while stopping the loom, and some devices require works on not only various devices provided in a loom but also every heald frame, that is, plural members such as, for example, within one shedding device. Similar operations are carried out at the time of setting weaving conditions, looming, gaiting, maintenance, repairing and the like.

Such works include, for example, in case of setting weaving conditions, positioning or adjustment of the height of a heald frame, cross timing of warps, a shedding amount and the like in a shedding device. In cases of looming and gaiting, for example, attaching and detaching or the like of the heald frame in a shedding device or attaching and detaching or the like of a reed in a beating-up device are also included.

Those works are carried out while stopping a drive actuator such as a motor for driving these devices at a predetermined position. It is complicating that a desired position for stopping the drive actuator varies from member to member composing the devices, and that sometimes one device requires a plurality of positions for stopping.

Heretofore, however, an operator had to stop the drive actuator at a desired position manually to perform in that state operations such as positioning, adjustment, setting and the like among the devices or composing members, holding an instruction manual describing a set value for each weaving condition by one hand.

Accordingly, the operation efficiency has so far been very bad. Also, in case of devices driven by a main shaft, special works such as, for example, inching the main shaft of a loom for positioning, releasing a brake for the main shaft and rotating the main shaft manually and so on are required, which means a great labor to stop the main shaft at a desired position. Furthermore, repeated inching operations shorten the life of a drive apparatus.

On the other hand, there is proposed a technique in which weaving conditions (data) are displayed on an image plane of a loom for an operator (a maintenance man) to perform adjusting work while watching the displayed image plane (Japanese Patent Appln. Publication (KOKOKU) No. 6-99860). Though this technique enables one to automatically confirm on a display whether set conditions have been met or not, it considers nothing about automatically positioning a drive actuator to drive the machines and devices.

As mentioned above, it has never been done to automatically drive a drive actuator to a position easy to work on machines and devices and stop there so that an operator can work at that position.

An object of the present invention lies in automatically driving an actuator for working on the machines and devices of a loom to a position easy to work on the devices.

SUMMARY OF THE INVENTION

The method of driving a loom according to the present invention comprises: setting information on a stop position for one or more of the devices of the drive actuator which drives the devices, prior to starting an operation for the devices of the loom; driving the drive actuator according to instructions to operate by a control circuit which controls the drive actuator; and stopping the drive actuator, based. on the stop position information.

The drive apparatus of the loom according to the present invention comprises: a drive actuator for driving one or more devices of the loom; a control circuit for controlling the drive actuator; and a setter for outputting contents set in the setter to the control circuit. Information for a stop position of the drive actuator relative to the devices prior to starting an operation of the devices is set in the setter, and the control circuit drives the drive actuator according to instructions for operations and stops the drive actuator, based on the information on the stop position.

A weft insert device, a shedding device, a beating-up device, a cloth take-up device, a warp let-off device and the like can be exemplified as the devices. These devices may be of a type to be driven by the main shaft of a loom, or may be of a type to be driven by an exclusive drive source.

A rotary drive mechanism such as an induction motor, a servomotor, a rotary solenoid or the like and a rectilinear drive mechanism such as a linear motor, an air cylinder, a hydraulic cylinder, or the like can be exemplified as a drive actuator.

Works for the devices are to be carried out while the loom is stopped, and the following can be exemplified as such works.

Works in setting weaving conditions, for example, in an shedding device, positioning and adjusting of closing timing (cross timing), a shedding amount or the like, and works relative to the shedding device.

Attachment and detachment of the devices themselves and members constituting them such as a heald frame of the shedding device, a reed of the beating-up device or the like at the time of looming and gaiting.

Oiling and confirmation of tightening of bolts and exchanging expendables for each device and the drive actuator at the time of maintenance work.

Works to be done at the time of repairing yarn breakage including warp yarn and selvage yarn.

Stop position information of the drive actuator is set prior to starting such works as above. This stop position information is set at a suitable time before performing the works on the devices.

Then, the drive actuator is driven according to operation instructions and is stopped on the basis of the set stop position information. In this state, the works on the devices are started by an operator.

Therefore, by presetting stop position information easy to work on the devices, the drive actuator is automatically driven to a desired position for readily carrying out the works on the devices and automatically stopped at that position.

The driving method and apparatus may be made to detect an amount of displacement of the output shaft of the drive actuator, and stop the drive actuator on the basis of the stop position information and the detected amount of displacement.

In the driving method and apparatus, it is possible to preset the stop information relative to plural work contents in the setter, to display the work contents on the setter, and to have the control circuit control the drive actuator according to selected work contents.

The driving method and apparatus may include works on a plurality of the machines and devices driven by the drive actuator, and the stop a position information for each device may be preset in the setter.

In the driving method and apparatus, the plural work contents include works where a plurality of stop positions are present for a specific device, and the stop position information corresponding to each work may be set in the setter.

In the driving method and apparatus, it is possible to preset the contents of work instructions for the works to be completed after the drive actuator is stopped, in addition to the work contents and the stop position information, to stop the drive actuator via the control circuit according to one of the work contents in the setter, and to make the setter display the contents of work instructions after the drive actuator is stopped.

BRIEF DESCRIPTION OF THE DRAWINGS

FIG. 3 is a view showing an embodiment of an operation image plane.

FIG. 4 is a view showing en embodiment of a selected image plane of an object machines and devices.

FIG. 5 is a view showing an embodiment of an image plane specifying an object operation.

FIG. 6 is a view showing an embodiment of an image plane confirming contents of an operation.

FIG. 7 is a view showing an embodiment of a guiding image plane.

FIG. 8 is a view showing an embodiment of a warning image plane.

FIG. 9 is a view showing an embodiment of an image plane instructing an operation.

FIG. 10 is a view showing an embodiment of an image plane for a message to stop driving.

PREFERRED EMBODIMENT OF THE INVENTION

Figure 1:
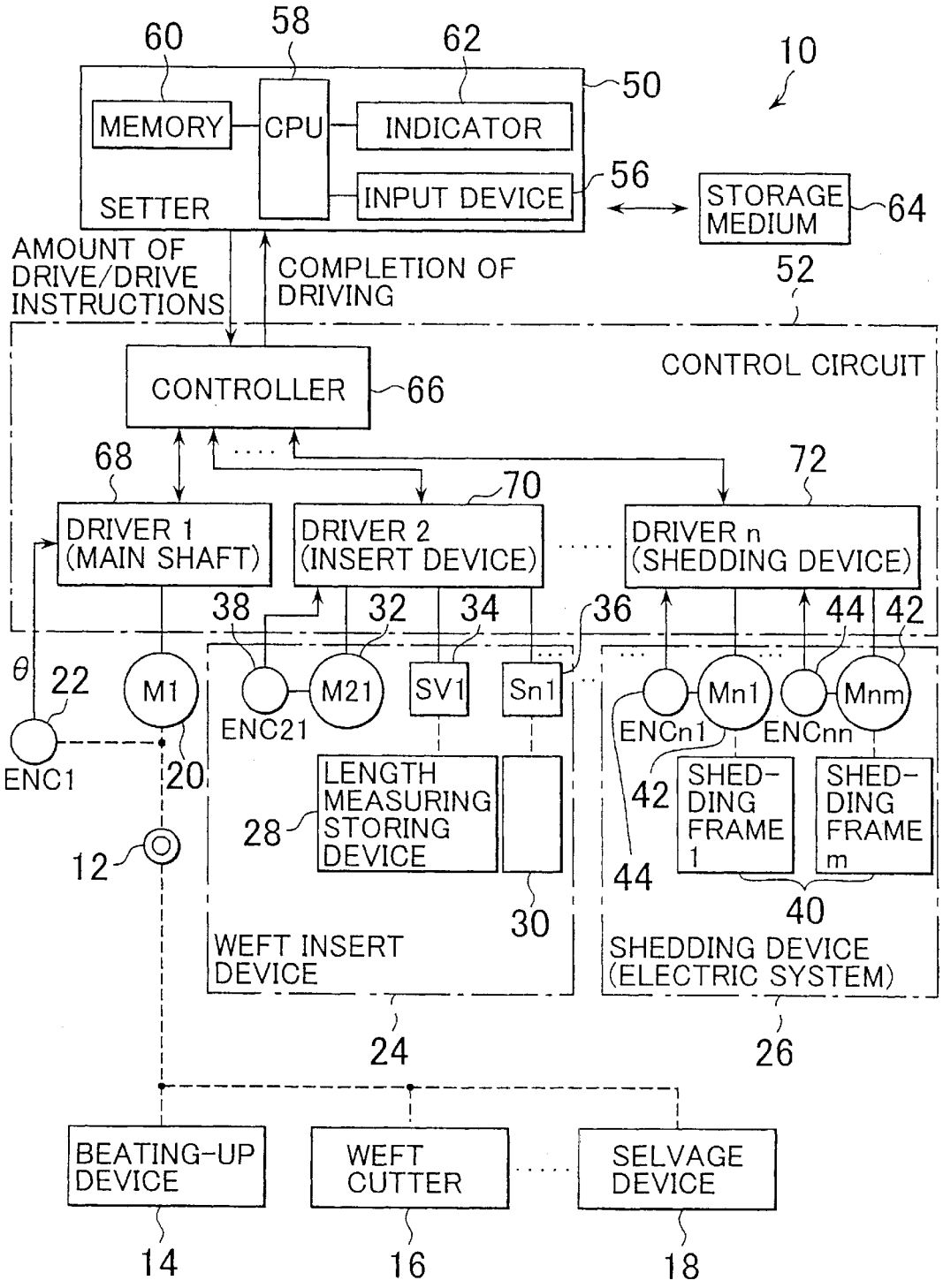
FIG. 1 is a block diagram showing an embodiment of a drive apparatus according to the present invention.

Referring to FIG. 1, the drive apparatus 10 is applied to a shuttleless loom comprising a plurality of devices to be driven by rotation of the main shaft 12 and a plurality of devices to be variably driven by one or more independent drive actuators.

The drive actuators are disposed considering their functions. A beating-up device 14, a weft yarn cutter 16, a selvage device 18 or the like can be enumerated as devices driven by the main shaft 12. The main shaft 12 is rotated by a main shaft motor 20 acting as one of the drive actuators.

The rotation of the main shaft 12 is transmitted to the beating-up device 14, the weft yarn cutter 16, the selvage device 18 or the like through a suitable motion converting mechanism (not shown). The rotation amount of the main shaft motor 20 is detected as a rotation angle signal θ representing a drive amount (rotation angle) of the main shaft 12 by a sensor or an encoder 22.

As the devices driven by one or more independent drive actuators, there are a weft insert device 24 capable of switching on or off of actions by changing of selected weft yarns, a shedding device 26 capable of switching on or off actions by changing of fabric designs, a cloth take-up device (not shown), a warp let-off device (now shown) and the like.

In the weft insert device 24, instruments such as a length measuring storing device 28, a weft yarn braking device 30, a weft yarn nozzle moving device (not shown), a weft yarn gripping device (not shown) or the like provided for each kind of weft yarns can be switched on or off whether to act or not by changing selected weft yarns.

The length measuring storing device 28 is provided as drive actuators with a rotary drive source 32 such as a motor for relatively rotating a yarn guide and a drum, and a drive source 34 for driving a lock pin. The weft yarn braking device 30 is provided as a drive actuator with a drive source 36 for driving braking members. Both drive sources 34, 36 can be employed as motors, solenoids, cylinder mechanisms or the like.

The amount of rotation (the amount of displacement of the output shaft) of the drive source 32 is detected as the rotation angle signal representing the driven amount (rotation angle) of the drive source 32 by the sensor or the encoder 38. The amounts of displacement of the drive sources 34, 36 are detected as their driven amounts by a sensor not shown.

The shedding device 22 is an electric device, which is provided not only with a plurality of shedding frames 40 but also a drive source 42 such as an electric motor or a solenoid as a drive actuator for driving each shedding frame 40. The amount of displacement of the drive source 42 is detected as its driven amount of the drive source 42 by a sensor or the encoder 44.

A cylinder mechanism may be used as the drive source 42. Also, the sensor for detecting the amounts of displacement of the output shafts of the drive actuator 20, 32, 34, 36, 42 may detect the amounts of displacement of the output shafts of the corresponding drive actuators or may detect the amounts of displacement of members driven by the corresponding drive actuators.

The drive apparatus 10 is also provided with a setter 50 for setting various information such as weaving conditions of the loom, working procedure relative to each device, stop position information of each drive actuator or the like, and a control circuit 52 for driving the drive actuators 20, 32, 34, 36, 42 on the basis of set various kinds of information.

The setter 50 receives the above-mentioned various kinds of information in an input device 56, feeds the received information to a central processing unit, i.e., central processor 58, stores the various information in a memory 60, and visually displays the various information on an indicator 62. By this, the above-mentioned various kinds of information are inputted into the setter to be set.

The input device 56 is provided with a device for reading the information stored in a storage medium 64 such as a memory card or a floppy disk, and a keyboard. The above-mentioned various kinds of information may be inputted into the setter 50 in a state of being prestored in the storage medium 64, or inputted into the setter 50 by transference from another computer, or inputted into the setter 50 in an interactive mode by utilizing the indicator 62 and the keyboard of the input device 56.

The information to be preset in the setter 50 is a stop position information to facilitate the works on the devices and includes stop position information for each device to be operated or each drive actuator. The stop position information can relate to a rotation angle of the output shaft if the drive actuator is of a rotating type, and a rectilinear moving position of the output shaft if it is of a rectilinear type. The stop position information may, however, relate to a rotation angle of movable members or a rectilinear moving position of the devices or may relate to a rotation angle of the output shaft or a rectilinear moving position as calculated therefrom.

The control circuit 52 receives and delivers data between itself and the setter 50 by a controller 66 and has a plurality of drivers 68, 70, 72 drive predetermined drive actuators. Each driver drives the corresponding drive actuator by using the control information inputted from the controller 66 and the amount of displacement of the output shaft of the corresponding actuator.

The following can be given as examples of works which require positioning of the actuator in the devices of the loom.

a) Setting of Weaving Conditions.

Beating-up device: setting of beating stroke (setting of a momentum of the drive apparatus), attachment and detachment/setting of a weft insert device (in an air jet loom, attachment and detachment of a nozzle and setting of an air jet direction, and in a rapier loom, setting of a rapier running guide), etc.

A weft yarn cutter: settings of cutting timing and strokes for each of a yarn supply side and a yarn non-supply side.

A selvage device: in case of, for example, a selvage device for leno elastic webbing, setting of closing timing (cross timing) for closing selvage forming yarns, adjustment of a mounting position corresponding to a cloth width and the like.

Shedding device: settings of a shedding amount, cross timing, frame height (warp line), etc., and exchanging drive cams, etc.

Weft insert device: setting of rapier insertion timing in a rapier loom, setting of a moving amount of a weft yarn insert nozzle in a jet loom of weft yarn insert nozzle moving type corresponding to weft selection, setting of a displacement amount of a weft braking device in an inserting weft decelerator, and setting of the outer diameter of a fixed drum in a fixed drum type weft yarn length measuring storing unit.

b) At the Time of Looming.

Beating-up device: attachment and detachment of a reed, attachment and detachment of a weft insert device, and the like.

Shedding device: attachment and detachment of a warp heald frame.

c) At the Time of Checking for Maintenance.

Oiling for each device, exchanging consumable parts, cleaning, overhaul, etc.

d) At the Time of Yarn Breakage.

Reparation of yarn breakage of a warp yarn, selvage yarn, catch cord yarn, etc. and exchanging empty bobbins, etc.

In case of, for example, a planetary gear type selvage device, it is easy to work if an empty bobbin is positioned at a top dead center. By doing so, a repairing work is facilitated by presetting the position of an empty bobbin with a broken yarn to select a work, rotating the main shaft from a stop angle for preventing stop mark to the top dead center where empty bobbins can be exchanged readily.

In the above-mentioned works, less accurate positioning condition is required to drive so far as the operability is not spoiled, depending on the contents of works. Also, depending on devices and the contents of works, it is possible to drive the actuators for positioning a plurality of times, or to drive a plurality of actuators one after another. Further, depending on the contents of works, it is possible to drive in a withdrawing direction not only an actuator of an object device but also an actuator of a device which may cause disturbance to the works.

Such kinds of works and object devices as mentioned above are preset in the setter 50 and stored in the memory 60 together with the corresponding contents of works, instruction operation of works and the stop position information as well as related display information.

As regards those driven by the main shaft 12 among the above-mentioned devices, it suffices to position the main shaft. As regards those driven by actuators other than the main shaft 12 and the main shaft motor 20, it suffices to position the corresponding actuators.

Also, a method of driving for positioning actuators other than the main shaft 12 and the main shaft motor 20 may be an independent drive system for each actuator or may be a simultaneous drive system for a plurality of actuators.

Further, in case the devices are provided with a plurality of actuators such as an electric shedding device having an actuator on every heald frame, a plurality of actuators may be simultaneously driven to a desired position. This makes a work such as oiling easier.

FIGS. 2–10 are examples for setting a closing timing of selvage forming yarns in a planetary gear selvage device of the weft yarn supply side (see, e.g., Japanese Utility Model Appln. Publication (KOKOKU) No. 50-20126). In these examples, the work contents are specified in an interactive mode, then the main shaft is stopped at a desired rotation angle position preset in a setter, and the instruction operation of the work contents are displayed on an indicator.

In this embodiment, the closing timing (cross timing) which is one of weaving conditions is set in consideration of the state of tightening of selvage or weft timing at the start of weft insertion. Also, an operator respond to the contents displayed in the indicator along a predetermined hierarchy of plural contents of work to be done for this loom, by way of a keyboard and the like, thereby narrowing down the work contents to be conducted thereafter. Then, after driving for positioning, a work to be done next is displayed, so that a state of progress can be readily grasped.

The planetary gear selvage device described in the foregoing Japanese UM Appln. Publication (KOKOKU) No. 50-20126 is constituted such that a planetary gear mounting an empty bobbin is meshed with a sun gear to be driven by a main shaft, and that even when a loom is rotated, a mail position of a selvage yarn can be displaced vertically. In more detail, it is a device for forming a selvage in leno elastic webbing by adding a leno to a selvage forming yarn relative to woven weft yarn and warp. As selvage devices other than the foregoing, however, there are a tuck-in apparatus, a leno apparatus and the like, to which the present invention can be applied.

Next, a method of driving by the drive apparatus 10 is described with reference to FIGS. 2–10. And a sequence of flow in setting a closing timing relative to the foregoing selvage device is given as an example.

First of all, a central processor 58 of the setter 50 carries out a step for opening an operation image plane according to the operator's instructions, and displacing this image plane on the indicator 62 of the setter 50 to display the contents of operation (step 101), and then a step for selecting work contents (step 102).

FIGS. 3–10 show the contents of display on the indicator 62 to be conducted along stored contents set for the setting operation. Firstly, the image plane of operation displays kinds of works, as shown in FIG. 3, which can be done to the drive apparatus, instructions to select works to be actually done and to input the corresponding No.

In the example of FIG. 3, a plurality of operations are displayed together with Nos. such as "1. setting," "2. looming," "3. maintenance" and "4. yarn breakage." By this, an operator can select a work to be done. Then, the operator inputs "1" corresponding to "setting" through: an input device 56. FIG. 3 shows a state that "setting" is selected.

When a work is selected, the central processor 58 makes the object device selection image plane displayed on the indicator 62 of the setter 50. The object device selection image plane displays the device to do the work as shown in FIG. 4 and instructions to input the corresponding No.

In the example of FIG. 4, the names of a plurality of devices are displayed together with Nos. such as "1. beating-up device," "2. shedding device," "3. weft insert device," "4. selvage device," "5. warp let-off device" and "6. weft yarn cutter" or the like. Thereby, the operator can select an object device to work on. Then, the operator inputs No. "4" corresponding to "selvage device" through the input device 56. FIG. 4 shows a state that the "selvage device" is selected.

When a device is selected, the central processor 58 makes the indicator 62 of the setter 50 display an image plane specifying an object work. As shown in FIG. 5, this image plane displays an object work and instructions to select the object work and to input the corresponding No.

In the example of FIG. 5, a plurality of object works such as "1. adjusting cloth width," "2. phasing of weft yarn supply side," "3. phasing of non-supply side," "4. oiling" and "5. empty bobbin filling" or the like together with their Nos. By this, the operator can select an object work. Then, the operator inputs the No. "2" corresponding to "phasing of weft yarn supply side" through the input device 56. FIG. 5 also shows a state that "phasing of weft yarn supply side" is selected.

When an object work is selected, the central processor 58 makes the indicator 62 of the setter 50 display the confirming contents of the works, i.e., an operation procedure of a series of phasing works, and the image plane to confirm the works is displayed by the indicator 62 of the setter 50 (step 103). This image plane displays the concrete contents of the work, as shown in FIG. 6 and instructions to input "Y" or "N" denoting yes or no after confirming whether or not the work to be performed is correctly selected.

In the example of FIG. 6, concrete work contents such as "(1) Main shaft rotates up to 290°" and "(2) Loosen transmission gear and fix at the position where shedding of the selvage forming yarns is almost closed" are displayed. Therefore, an operator can confirm the contents of the works and select the contents of the work to be performed. Then, the operator inputs "Y" which corresponds to "Yes" through the input device 56. Incidentally, FIG. 6 shows a state that "Yes" is selected.

The above "290°" is a stop position information of the main shaft 12 previously inputted in the setter 50 and stored in the memory 60, and is a rotation angle of the main shaft 12 for the operator to perform the work most easily. More particularly, it is an angle for adjusting a closing timing of the weft supply-side selvage forming yarns and set as a weaving condition. This stop position information can be read out by the central processor 58 from the memory 60.

When the contents of the work are confirmed, the central processor 58 starts driving for positioning and displays a notice image plane for warning on the indicator 62 of the setter 50 (step 104). This notice image plane displays to inform, as shown in FIG. 7, that the main shaft is rotating.

In the example of FIG. 7 is shown a question such as "(1) The main shaft is rotatable up to 290°. To be executed?" Thereby, the operator can select whether to start rotating the main shaft or not. Then, the operator inputs "Y" corresponding to "execute" through the input device 56. Incidentally, FIG. 7 shows a state that "Y" is selected.

When "Y" is selected, the central processor 58 outputs to the control circuit 52 instructions to rotate the main motor 20 until the main shaft is rotated to 290° for positioning and during the time displays a warning image plane as shown in FIG. 8 on the indicator 62 of the setter 50. This warning image plane questions, as shown in FIG. 8, as to whether to execute rotating the main shaft or not and instructions to input "Y" or "N" denoting whether to stop rotating or not.

In the example of FIG. 8 are displayed a warning "The main shaft is rotating up to 290°" and a question "To be stopped?" Thereby, the operator comes to know that the main shaft is rotating and can input whether to stop it or not in case where he had to stop driving for some reason or other. FIG. 8 shows a state that "Not to be stopped" is selected.

While the warning image plane is on display, the central processor 58 determines whether or not a stop button (Y button) is pressed down (step 105).

Unless the stop button is pressed, the central processor: 58 (i.e., controller 66) continues to rotate the main shaft and stops driving the main shaft when the main shaft is rotated up to 290° (step 106). Whether or not the main shaft has reached 290° is determined by using an output signal of an encoder 22.

When the main shaft is rotated up to 290°, the controller 66 sends the signal of completion of driving to the central processor 58, the main shaft stops rotating, and the central processor 58 makes the indicator 62 of the setter 50 display an image plane for work instructions. As shown in FIG. 9, this image plane for work instructions displays the completion of the driving of the main shaft, instructions for the contents of the works, and to input with "Y" or "N" as the answer to the question whether or not the work is completed.

In the example of FIG. 9 are shown a display of information reading "(1) the main shaft finished driving (stopped at 290°)" and concrete work contents to be done. By this, the operator comes to know that the rotation of the main shaft was completed and, according to the displayed concrete instructions of work contents, loosens the bolt of the drive gear to release the connection with the drive shaft, and after bringing the selvage forming yarn into a closed state by manually turning the transmission gear of the selvage device, fixes (tightens) the loosened bolts. After the works are completed, the operator inputs the symbol "Y" corresponding to "Works are completed" through the input device 56. FIG. 9 shows a state that "Works are completed" is selected.

If "Stop" is indicated as a result of the determination by pressing the "Y" button in step 105, the central processor 58 instructs the controller 66 of the control circuit 52 to stop driving, and the controller 66 stops driving the main shaft motor 20, and makes the main shaft stop rotating, and the central processor 58 makes the indicator 62 display a message to the effect that the driving was stopped (Step 108). This message includes, as shown in FIG. 10, a guidance to confirm, by pressing the stop button down, that the driving of the main shaft was stopped and a guidance to input whether a confirmation was made or not by "Y" or "N." FIG. 10 displays a state that "Confirmed" was selected.

In step 107, when "Works are completed" is selected, the central processor 58 finishes the setting work, In step 108, when "Confirmed" is selected, the central processor 58 finishes a series of setting works.

In a device having a synchronizing relation with a main shaft maintained by the foregoing setting works, processing can be finished as it is. However, in some devices driven by a drive actuator independent from a main shaft, a lag in synchronization is caused by completion of works. In such a case, restoring work such as positioning for synchronizing relative to the main shaft is done manually or automatically after works to the devices are finished.

Figure 2:
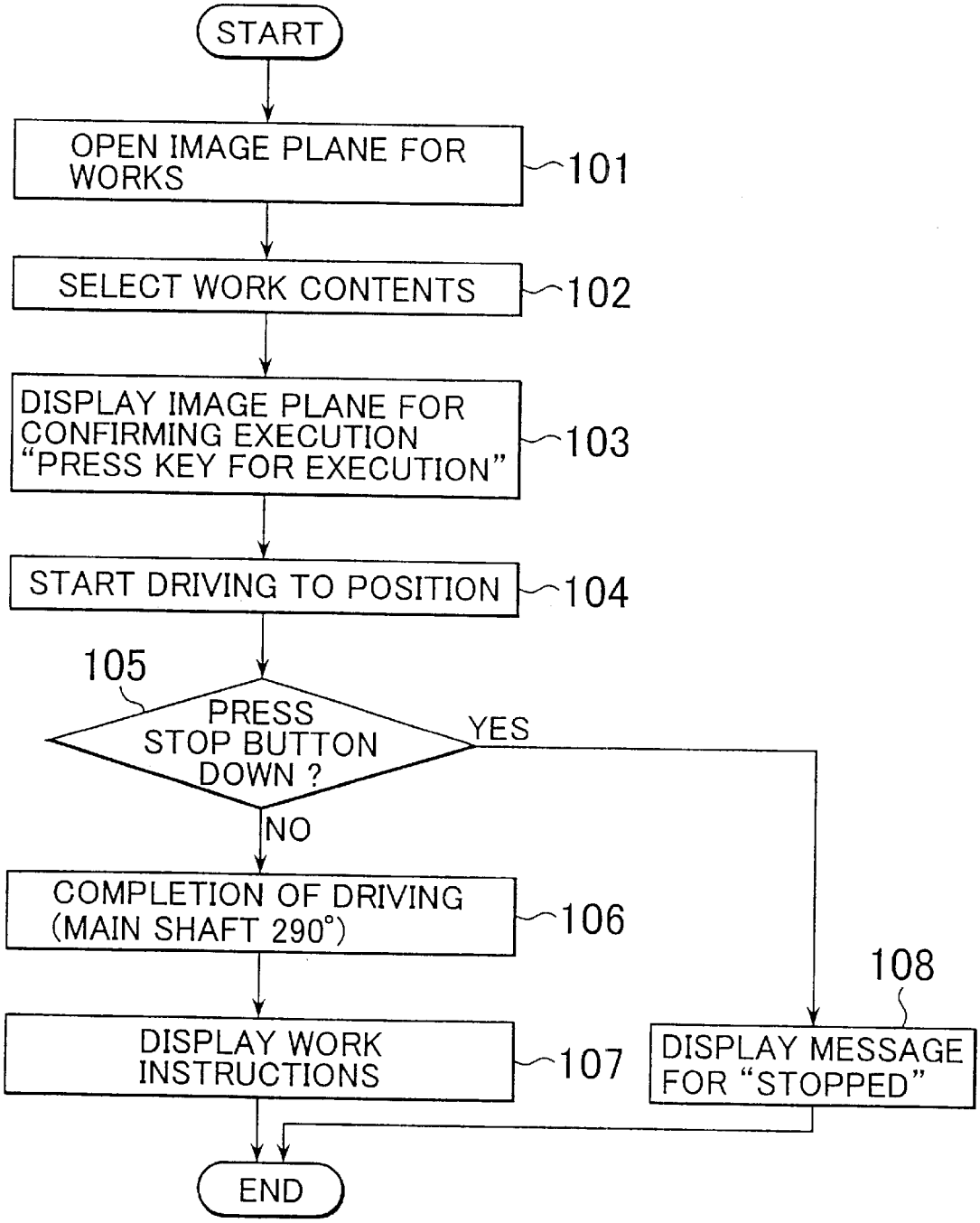
FIG. 2 is a flow chart for explaining an embodiment of a driving method by using the drive apparatus shown in FIG. 1.

Though not shown in FIG. 2, it is a matter of course that it is programmed and stored such that, in case different devices or work contents are selected by erroneous inputting in the foregoing step, a selection work can be done again by inputting the symbol "N" to return to the previous step.

Even when other kinds of works, other object devices, and other contents of object works are selected, the central processor 58 makes the indicator 62 display information corresponding to the selected kinds of works and object devices and contents of object works and requests the operator to confirm various matters and does various guidance. Accordingly, the operator can efficiently promote the works on the devices, thereby considerably shortening the time required for the works.

While a controller is provided in the foregoing embodiment, it is possible to make the central processor of the setter control a driver. Also, instead of means for detecting an amount of displacement, another device, e.g., a simple device such as a dog and a proximity switch may be employed. Further, instead of positioning an actuator by using an output signal of a sensor, it is possible to mechanically position the actuator, for example, to stop the actuator by having it engage with a projection formed on a rotating object.

The present invention can be applied not only to devices provided on a loom but also to devices which need works on the devices such as the devices to be attached to a loom, that is, a cloth doffing machinery or device, a looming machinery and the like.

The present invention is not limited to the above embodiments but can be variously modified without departing from its gist.

What is claimed is:

1. A method of driving a loom, comprising steps of:

setting a drive actuator's stop position information relative to one or more devices of a loom prior to adjusting, maintaining, or initializing said devices;

driving said drive actuator according to operation instructions by a control circuit which controls said drive actuator; and stopping said drive actuator on the basis of said stop position information.

2. A method of driving as defined in claim 1, further comprising the steps of: detecting an amount of displacement of an output shaft of said drive actuator and stopping said drive actuator, via said control circuit, on the basis of said stop position information and the detected amount of displacement.

3. A drive apparatus of a loom, comprising: a drive actuator for driving one or more devices of a loom; a control circuit for controlling said drive actuator; and a setter for outputting contents set therein to said control circuit;

wherein said setter contains stop position information of said drive actuator relative to said devices, said stop position information input to said setter prior to adjustment, maintenance, or initialization of said devices; and wherein said control circuit drives said drive actuator according to operation instructions and stops said drive actuator on the basis of said stop position information.

4. A drive apparatus as defined in claim 3, further comprising: a sensor for detecting an amount of displacement of the output shaft of said drive actuator, said sensor in communication with a control circuit;

wherein said control circuit stops said drive actuator on the basis of said stop position information and the amount of displacement detected by said sensor.

5. A drive apparatus as defined in claim 3, wherein said setter contains stop position information relative to a plurality of work contents previously set in said setter, wherein said setter displays said plurality of work contents, and wherein said control circuit controls said drive actuator according to the work contents selected from among the contents displayed on said setter.

6. A drive apparatus as defined in claim 5, wherein said plurality of work contents includes works relative to said devices to be driven by said drive actuator, and wherein said setter contains stop position information relative to each of the devices.

7. A drive apparatus as defined in claim 5, wherein said plurality of work contents includes works where a plurality of stop positions exist for a specific device, and wherein said setter contains stop position information corresponding to each work.

8. A drive apparatus as defined in claim 6, wherein, in addition to said work contents and said stop position information, said setter contains preset work instruction contents for works to be completed after the stopping of said drive actuator, wherein said control circuit stops said drive actuator according to a selection of work contents in said setter, and wherein said setter displays said work instruction contents after said drive actuator stops.

* * * * *

UNITED STATES PATENT AND TRADEMARK OFFICE

CERTIFICATE OF CORRECTION

PATENT NO. : 6,532,996 B2
DATED : March 18, 2003
INVENTOR(S) : Zenji Tamura

It is certified that error appears in the above-identified patent and that said Letters Patent is hereby corrected as shown below:

Column 2,
Line 21, “based. on the” should read -- based on the -- (delete period).
Lines 46-47, “in an shedding” should read -- in a shedding --.

Column 3,
Line 43, “showing en embodiment” should read -- showing an embodiment --.
Line 44, “plane of an object machines” should read -- plane of object machines --.

Column 6,
Line 45, “respond to” should read -- responds to --.
Lines 56-57, “a mail position” should read -- a male position --.

Column 8,
Line 34, “central processor: 58” should read -- central processor 58 -- (delete colon).

Column 9,
Line 9, after “work” and before “In” delete comma and insert period (.).

Signed and Sealed this

Eighth Day of July, 2003

JAMES E. ROGAN
*Director of the United States Patent and Trademark Office*